US012078039B2

(12) United States Patent
Thorpe et al.

(10) Patent No.: US 12,078,039 B2
(45) Date of Patent: Sep. 3, 2024

(54) AUTOMATED PLUNGER CATCHER ACTUATOR AND METHOD

(71) Applicant: JBT Products, Inc., Houston, TX (US)

(72) Inventors: Glenn Weldon Thorpe, Spring, TX (US); Richard A. Beers, Choctaw, OK (US)

(73) Assignee: JBT Products, Inc., Houston, TX (US)

( * ) Notice: Subject to any disclaimer, the term of this patent is extended or adjusted under 35 U.S.C. 154(b) by 0 days.

(21) Appl. No.: 18/204,335

(22) Filed: May 31, 2023

(65) Prior Publication Data

US 2023/0383630 A1 Nov. 30, 2023

Related U.S. Application Data

(60) Provisional application No. 63/347,109, filed on May 31, 2022.

(51) Int. Cl.
*E21B 43/12* (2006.01)
*E21B 33/068* (2006.01)

(52) U.S. Cl.
CPC ..... *E21B 43/122* (2013.01); *E21B 33/068* (2013.01)

(58) Field of Classification Search
CPC ..... E21B 43/122; E21B 33/068
See application file for complete search history.

(56) References Cited

U.S. PATENT DOCUMENTS

| | | | | |
|---|---|---|---|---|
| 7,040,401 | B1 * | 5/2006 | McCannon | F04B 47/12 166/70 |
| 8,181,706 | B2 * | 5/2012 | Tanton | E21B 43/121 166/372 |
| 2008/0149182 | A1 * | 6/2008 | Burkhard | E21B 21/08 137/12 |
| 2018/0100381 | A1 * | 4/2018 | Agarwal | E21B 33/068 |
| 2023/0066565 | A1 * | 3/2023 | Navar | E21B 33/08 |
| 2023/0098068 | A1 * | 3/2023 | Peterson | E21B 47/009 166/250.15 |

* cited by examiner

*Primary Examiner* — Brad Harcourt
(74) *Attorney, Agent, or Firm* — Patrick K. Steele

(57) ABSTRACT

An actuator to operate a plunger catcher to capture and release a plunger used in a plunger-assisted artificial lift system. A case is connectable to a lubricator on a wellhead and a motor drives a rotary shaft. A plunger sensor is disposed proximal to the lubricator and connected to a distal end of a plunger rod. A proximal end of the plunger rod extends into the case and is coupled to the rotary shaft. A source of current connects to the motor. A processor/controller controls operation of the motor, and a plunger sensor detects the presence of the plunger within the lubricator. The actuator may be operated to capture the plunger within the lubricator by extending the plunger rod outwardly from the case, and later to retract the plunger rod inwardly to release the plunger.

13 Claims, 6 Drawing Sheets

AUTOMATED PLUNGER CATCHER ACTUATOR AND METHOD

CROSS-REFERENCE TO RELATED APPLICATIONS

This application depends from and claims priority to U.S. Provisional Patent Application Ser. No. 63/347,109 filed on May 31, 2022, which application is incorporated by reference herein.

BACKGROUND

Field of the Invention

The present invention relates to devices used in artificial lift systems for producing oil and gas from wells drilled into the earth's crust. More specifically, the present invention relates to an apparatus for securing and releasing a plunger that enables a plunger-assisted artificial lift system.

Background of the Related Art

Artificial lift systems are used to enable production of oil and gas from wells that, due to the removal of oil and gas from a subsurface hydrocarbon-bearing formation, lack the reservoir pressure to sustain continuous flow to surface production facilities and equipment. In one type of artificial lift system called the plunger lift system, gas is injected at the surface into an annulus intermediate the casing and a production tubing, and forced down the annulus to a set of perforations in the bottom of the production tubing to enter the production tubing and thereby lighten the column of fluid in the production tubing to promote the flow of the column of fluid to the surface. A plunger is disposed within the production tubing. A control valve is closed to prevent fluid from escaping the section of the production tubing. The fluid entering the production tubing from the formation and the gas injected into the annulus causes the pressure within the production tubing to increase, especially as gas bubbles migrate towards the lower pressure at the top of the production tubing. At a predetermined upper pressure threshold, or after a predetermined time period, the surface valve is opened to allow the pressurized fluid within the production tubing to escape the production tubing and to flow from the well, through the surface valve and to a flow line or a production storage tank. The plunger in the production tubing is carried to the surface as the fluid in the production tubing surges to the surface. The plunger acts like a piston as it travels to the surface to assist in displacing fluid from the production tubing. The plunger is captured and secured within the lubricator to remove it from the flowpath through which fluids move as they are released from the wellhead.

After the production tubing is depressurized, the surface valve is closed in preparation for another cycle. The plunger is released to sink within the production tubing. Formation fluids begin flowing into the production tubing and the cycle is then repeated.

Details relating to the plunger-assisted gas lift system can be found on a website operated by Kimray, Inc. at https://www.youtube.com/watch?v=ETixMStzlW0 and also in the published patent application, U.S. Patent Application Publication No. 2023/0019787. Various types of plungers can be used with embodiments of the apparatus of the present invention. The plunger-assisted gas lift system operates on a repeating cycle basis, the cycle length being determined by factors including the gas/oil ratio of the fluids entering the well at the geologic formation, the rate at which gas is injected into the annulus of the well, the level at which the gas in the annulus enters the production tubing to mix with the fluids from the geologic formation, the bottom hole pressure of the well and other factors.

BRIEF SUMMARY

One embodiment of the plunger catcher actuator of the present invention provides an apparatus to cooperate with a plunger-assisted gas lift system being used to produce fluids from a well drilled into the earth's crust and in communication within the earth's crust with a hydrocarbon-bearing subsurface geologic formation. The plunger catcher actuator is electrically-powered and includes an electric motor to extend a plunger rod outwardly and away from case of the actuator and, upon deactivation, to withdraw the plunger rod inwardly and into the case. A proximal end of the plunger rod is received through a wall of the case and into the interior of the case to couple with a rotatable output shaft of the electric motor through an intermediate linkage. A distal end of the plunger rod is connectable to a plunger catcher that is movable with the plunger rod outwardly away from the case with the plunger rod to engage and secure the plunger within or proximal to the lubricator, and then movable with the plunger rod inwardly towards the case with the plunger rod to disengage and release the plunger.

One embodiment of the plunger catcher actuator of the present invention that can be used with a plunger-assisted gas lift system comprises a case having a mounting member for coupling the case in a fixed position relative to a lubricator on a wellhead, the case having an aperture to receive a plunger rod, an electric motor connectable to a source of electrical current and an output shaft controllably rotatable by the electric motor. At least a portion of the output shaft is disposed within an interior space of the case, and that portion is coupled to a proximal end of a plunger rod. The actuator includes a current sensor to detect the current being provided to the electric motor and to generate a signal to a processor/controller corresponding to the sensed current. The processor/controller is activatable by a signal from a plunger sensor disposed within or proximal to the lubricator of the wellhead, and compares the signal from the current sensor to a set point. The processor/controller generates a control signal to the electric motor to generate a predetermined amount of torque to the output shaft. A lever arm is coupled to the output shaft of the electric motor at a first end of the lever arm, and coupled to the plunger rod at the second end of the lever arm. Upon activation of the motor by the processor/controller, rotation of the output shaft by the electric motor rotates the lever arm to extend the plunger rod outwardly from the case. The torque applied by the motor to the rotary shaft produces a predetermined amount of torque to the output shaft, and the electric motor continues to produce that amount of torque until the control signal is changed or interrupted.

In one embodiment of the plunger catcher actuator of the present invention, a motor enclosure that is connected to the case, and the electric motor may resides within the motor enclosure. The rotary shaft extends from the electric motor and penetrates a wall of the motor enclosure and an adjacent wall of the case. A shaft seal may be provided intermediate a wall of the case and the rotary shaft. Similarly, the case may include a seal disposed intermediate the plunger rod and a wall of the case. The seals prevent unwanted contaminants from entering the case and/or the motor enclosure. The case and/or the motor enclosure may be of an explosion proof construction. In one embodiment of the plunger catcher actuator of the present invention, the source of electrical current may be a battery, and the battery may be connected to at least one electrical current-generating solar panel exposed to sunlight to provide for recharging the battery.

An embodiment of a method of the present invention may enable reliable and efficient capturing and securing a plunger within a lubricator of a wellhead to enable the use of a plunger-assisted gas lift system, and may comprise the steps of providing a case connectable to the lubricator on a wellhead, the case having an aperture to receive a proximal end of a plunger rod, providing a motor coupled to a source of electrical current, the motor having a rotary shaft that is rotatable by the motor. The method may further include the step of providing a linkage intermediate the rotary shaft and the proximal end of the plunger rod received into the case to impart an actuating force to displace the plunger rod in an outwardly direction from the case. The method may further include the step of coupling a plunger catcher to a distal end of the plunger rod that is outside the case and in a position to be extended, upon activation of the motor, into the lubricator of the wellhead. The method may further include the step of providing a plunger sensor proximal to or within the lubricator and adjacent to the plunger catcher on the distal end of the plunger rod to generate a signal upon detection of the plunger within the lubricator, and the step of providing a processor/controller to control the amount of current provided by the source of electrical current to the motor upon receiving the signal from the plunger sensor indicating the arrival of the plunger within the lubricator. The plunger sensor, upon arrival of the plunger within the lubricator, generates a signal to the processor/controller which activates the motor by delivering a predetermined electrical current from the source of electrical current to the motor to drive the plunger rod outwardly from the case to engage the plunger catcher against the plunger, thereby securing the plunger within the lubricator.

One embodiment of the method of the present invention further includes the step of providing a pressure sensor to generate a signal to the processor/controller upon detection of a predetermined drop in pressure within the lubricator. Upon detection of the predetermined pressure threshold, the processor/controller activates the motor to turn the rotary shaft in an opposite direction to thereby retract the plunger rod inwardly into the case to move the plunger catcher away from the plunger to release the plunger.

One embodiment of the method of the present invention further includes the step of providing a timer to generate a signal to the processor/controller upon elapse of a predetermined time interval after an event such as, for example, opening of a control valve to unload the pressurized well or capture of the plunger within the lubricator. Upon detection of the elapse of the predetermined time period, the processor/controller activates the motor to turn the rotary shaft in an opposite direction to thereby retract the plunger rod inwardly into the case to move the plunger catcher away from the plunger to release the plunger.

One embodiment of the method of the present invention incudes the steps of providing a solar panel to generate electrical current, connecting the solar panel to a battery and connecting the battery to the motor to provide electrical current to operate the motor to move the plunger rod. The solar panel provides for efficient and reliable charging of a battery to energize the motor upon receiving a command signal from the processor/controller.

One embodiment of the method of the present invention includes the step of providing a motor enclosure adjacent to the case to enclose the motor and/or the processor/controller.

One embodiment of the method of the present invention includes the step of providing sealing elements round the plunger rod to isolate the case from pressurized fluids within the lubricator.

One embodiment of the method of the present invention includes the steps of determining the desired amount of force to be applied to the plunger rod to secure the plunger within the lubricator and determining the desired amount of torque to be imparted by the motor to the shaft to impart the desired amount of force to the plunger rod. A further step of the method may include determining the desired amount of electrical current to be provided to the motor to generate the desired amount of torque. The method may further include the steps of entering into the processor/controller a set point corresponding to the desired amount of electrical current to be provided to the motor and programming the processor/controller to deliver the desired amount of electrical current from the source of electrical current upon receiving the signal from the plunger sensor.

DETAILED DESCRIPTION

Figures 1, 2, 3, 4:
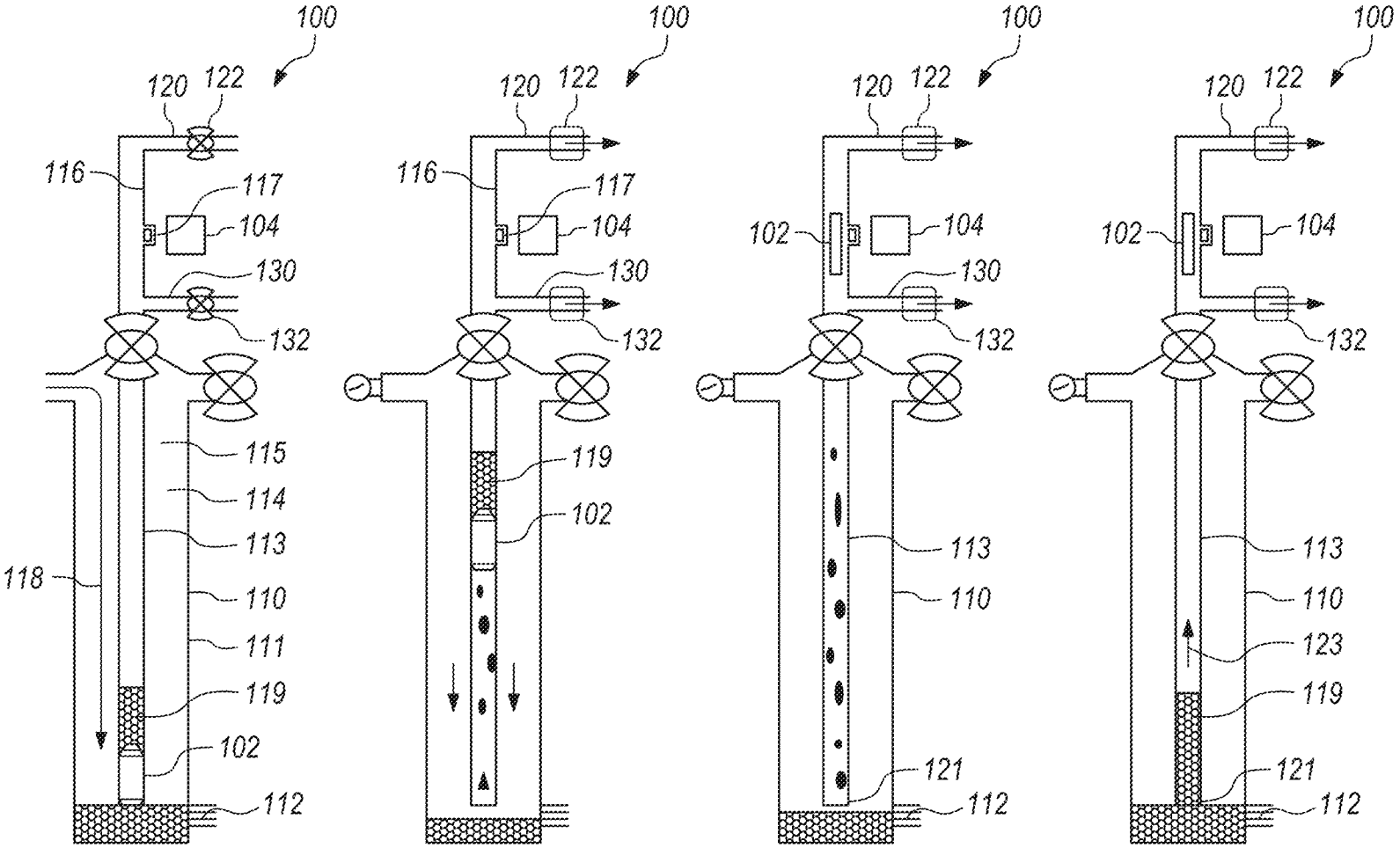
FIG. 1 is an illustration of a well being produced using a plunger-assisted gas lift system in the shut-in stage.
FIG. 2 is an illustration of the well of FIG. 1 in the unloading stage.
FIG. 3 is an illustration of the well of FIG. 2 in the flowing stage.
FIG. 4 is an illustration of the well of FIGS. 1-3 in the flowing-loading stage.

FIG. 1 is an illustration of a well 110 being produced using a plunger-assisted gas lift system in the shut-in stage. The well 110 produces to a wellhead 100 at the surface of the earth. Formation fluids enter the well 110 from a subsurface geological formation 112 that bears hydrocarbon fluids. The well 110 includes a string of casing 111 and a string of production tubing 113 run within the bore 115 of the casing string 111, thereby forming an annulus 114 intermediate the production tubing 113 and the casing string 111. The wellhead 100 includes a control valve 132 on a main pipe 130 and a bypass valve 122 on a bypass pipe 120. A plunger catcher 104 is coupled to a lubricator 116 to secure and capture a plunger 102 within the lubricator 116 when a sensor 117 indicates the arrival of the plunger 102 within the lubricator 116. A volume of formation fluid 119 is shown to have accumulated within the production tubing 113 above the plunger 102, but no fluid reaches the wellhead 100 due to a lack of sufficient pressure in the geologic formation 112.

FIG. 1 illustrates a loading stage of the plunger-assisted gas lift system cycle. Compressed gas from source of pressurized gas (not shown) is injected into the annulus 114 as indicated by arrow 118. The injection of compressed gas pressurizes the annulus 114 and the formation fluid 119 in the production tubing 113 and in the geologic formation 112. The bypass valve 122 and the control valve 132 are closed to contain the pressure within the well.

FIG. 2 is an illustration of the well 110 of FIG. 1 in the unloading stage. The bypass valve 122 is opened to allow pressurized injected gas and pressurized fluid to escape the well 110. The surge of gas and fluid to the wellhead 100 and from the wellhead 100 through the bypass valve 122 causes the plunger 102 to move with the escaping injected gas and formation fluid towards the wellhead 100. The plunger 102 moves as a piston within the production tubing 113 to push the formation fluid 119 upwardly towards the wellhead 100 as the pressure within the production tubing 113 is reduced. The injected gas, and gas that is liberated from the formation fluid 119 due to reduced pressure, expands as the gas migrates towards the wellhead 100, thereby lightening the hydrostatic head of the formation fluid and injected gas mixture that moves up the production tubing 113. The control valve 132 may remain closed during the unloading stage shown in FIG. 2.

FIG. 3 is an illustration of the well 110 of FIG. 2 in the flowing stage. The plunger 102 has arrived at the lubricator 116 and the plunger sensor 117, which may, in one embodiment be a magnetic sensor, generates a signal to the plunger catcher assembly 104. The plunger catcher assembly 104 engages and secures the plunger 102 in the lubricator 116. The control valve 132 is opened to allow further depressurization of the production tubing 113 and further flow of fluids and injected gas from the production tubing 113. Injected gas residing in the annulus 114 expands and continues to feed into the production tubing 113 as the fluids and injected gas within the well 110 continue to depressure and escape through the control valve 132.

Eventually, after most of the injected gas, gas liberated from depressured formation fluid and the gas liberated from the formation fluids escape the well 110 through the control valve 132, the control valve 132 and the bypass valve 122 are restored to the closed position.

FIG. 4 is an illustration of the well 110 of FIGS. 1-3 in the flowing-loading stage. Formation fluids 119 from the geologic formation 102 again begin to flow into the bottom 121 of the production tubing 113. An increasing column of formation fluids grows from the bottom 121 of the production tubing 113 as indicated by arrow 123. The plunger catcher 104 is disengaged to release the plunger 102 which descends downwardly through the production tubing 113 and back to the original position at the bottom 121 of the production tubing 113. After a sufficient volume of formation fluid accumulates and some pressure builds in the production tubing 113, and after the plunger 102 is restored to its original position at the bottom 121 of the production tubing 113, the cycle is completed, the control valve 132 and the bypass valve 122 remain closed and the cycle begins again with gas injection into the annulus 114.

Figure 5:
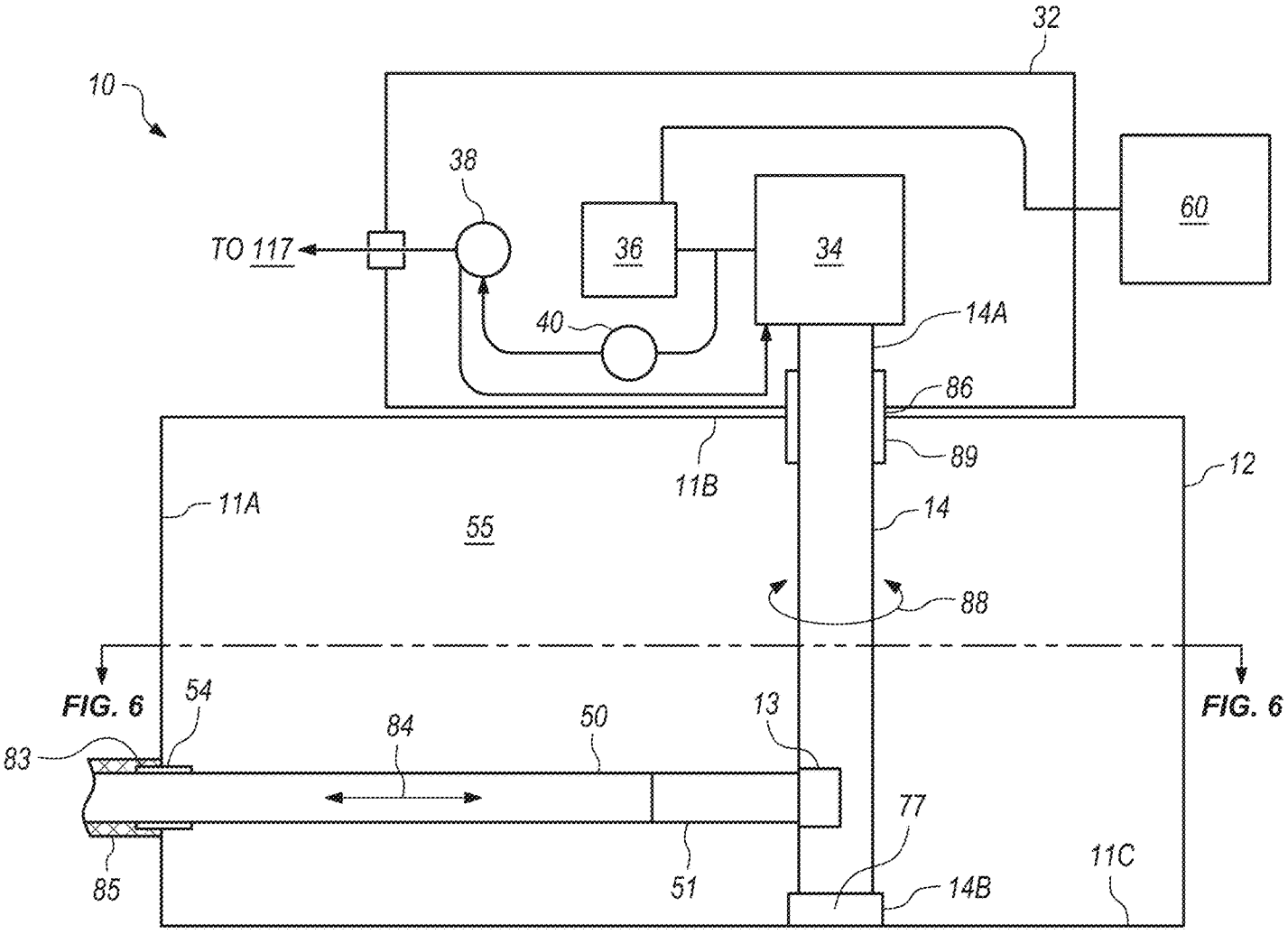
FIG. 5 is an elevation view of an embodiment of an automated plunger actuator of the present invention.

FIG. 5 is an elevation view of an embodiment of an automated plunger actuator of the present invention. The present invention is directed to the use of an automated plunger catcher actuator, such as the embodiment shown in FIG. 5, to position and control the movement of a plunger disposed proximal to the lubricator of a wellhead to capture and secure a plunger being used in a plunger-assisted gas lift system implemented in a well drilled into the earth's crust to establish fluid communication with a hydrocarbon fluid bearing subsurface geologic formation. Many wells drilled to extract hydrocarbon fluids from these geologic formations either lack the pressure to sustain fluid production to the surface or become depleted by unassisted production until the reservoir pressure is no longer sufficient to sustain fluid flow to the surface. Artificial lift systems can be utilized to extract fluids from wells by, for example, the installation of submersible electric downhole pumps, the injection of gas down an annulus and into gas lift mandrels or perforations in the bottom portions of the production tubing to lighten the hydrostatic head within the well.

A wide variety of plungers that can be utilized with a plunger-assisted gas lift system can be made, and the present invention is directed to the assembly that can be used to capture the plunger upon detected entry into the lubricator of a wellhead and then to later release the plunger to sink downwardly within the bore of the production tubing to finally land on a seat at the bottom of the wellbore, and in that manner control the movement of plunger.

The present invention is directed to automated plunger catcher actuator that applies a predetermined amount of force to a plunger rod that is coupled to a plunger catcher disposed on a distal end of the plunger rod. The plunger rod penetrates the wall of the lubricator intermediate the interior space within the lubricator and the automated plunger actuator of the present invention.

FIG. 5 shows a case 12 of one embodiment of the present invention 10 disposed proximal to a motor enclosure 32. The case 12 includes a distal wall 11A, a top wall 11B and a bottom wall 11C. In one embodiment of the present invention, the case 12 may be pressurized or explosion proof to prevent the introduction of hydrocarbons into the interior space 55 of the case 12. The case 12 of FIG. 5 includes a shaft aperture 86 in the top wall 11B through which a rotatable shaft 14 passes. The shaft 14 passes through a seal 89 that is disposed intermediate the shaft 14 and the aperture 86 in the top wall 11B of the case 12. A distal end 14B of the shaft 14 may be coupled to a bearing 77 disposed on the bottom wall 11C of the case 12 to provide stability to the rotatable shaft 14. A proximal end 14A of the shaft 14 resides in the motor enclosure 32 and is coupled to an electric motor 34 that, upon activation of the motor 34 by electric current, rotates to impart a predetermined amount of torque to the rotatable shaft 14. The electric current to operate the electric motor 34 is provided from a current source such as, for example, a battery 36. In one embodiment of the plunger catcher actuator 10 of the present invention, the battery 36 may be coupled to one or more solar-powered electrical current generation panels 60 that are outside the case 12 and exposed to sunlight for charging the battery 36.

The motor 34 is controlled by a processor/controller 38. The plunger sensor 117 (not shown in FIG. 5—see FIGS. 1-4), upon detecting the arrival of the plunger 102 in the lubricator 116 of the wellhead 100, generates a signal to the processor/controller 38 which, in response to the signal from the plunger sensor 117, activates the motor 34 by controlling the electrical current delivered from the battery 36 to the motor 34. A current sensor 40 produces a signal to the processor/controller 38 indicating the amount of current being delivered by the battery 36 to the motor 34. The processor/controller 38 compares the sensed current to a current set point that coincides with a desired amount of torque to be imparted to the shaft 14 by the motor 34, that desired amount of torque being that which produces a desired amount of force applied to the plunger rod 50 and to a plunger The shaft 14 of FIG. 5 includes a lever arm 13 extending from the shaft 14 and coupled to a plunger rod 50. The plunger rod 50 is received through an aperture 54 in the distal wall 11A of the case 12 and coupled to an intermediate link 51 that is, in turn, coupled to the lever arm 13 extending from the shaft 14. As described in more detail below, the motor 34 rotates the shaft 14 to rotate the lever arm 13 and to move the intermediate link 51 and the plunger rod 50 back and forth as indicated by double-headed arrow 84.

Figure 6:
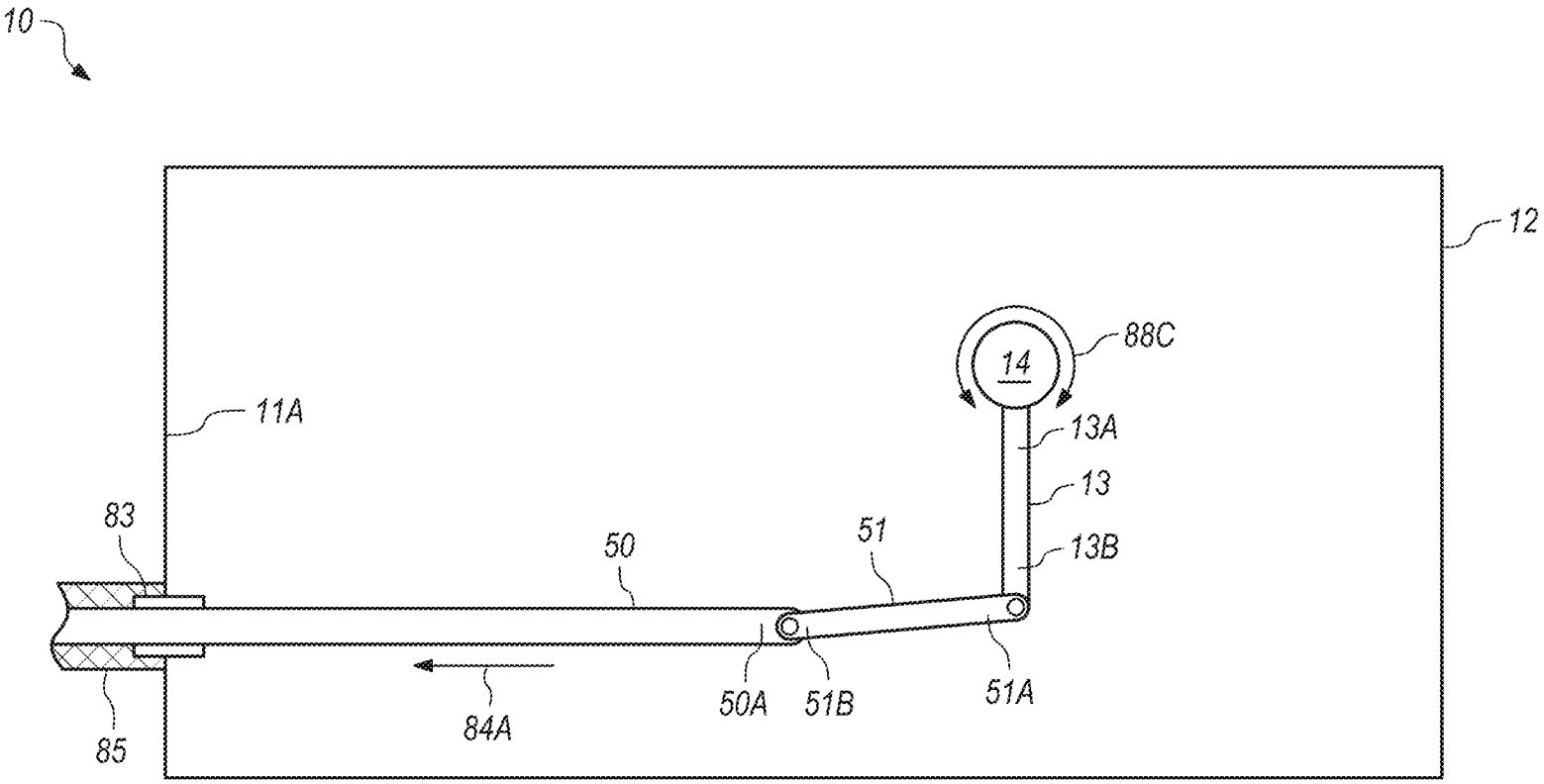
FIG. 6 is a sectional view of the automated plunger actuator of FIG. 5 in a retracted configuration.

FIG. 6 is a sectional plan view of the automated plunger actuator 10 of FIG. 5 in a retracted configuration. FIG. 6 shows the shaft 14, which is rotatable by the motor 34 as indicated by the double-headed arrow 88C, the lever arm 13 connected to the shaft 14 at a proximal end 13A, the intermediate link 51 coupled at a proximal end 51A to a distal end 13B of the lever arm 13, and the plunger rod 50 coupled at a proximal end 50A to a distal end 51B of the intermediate link 51B. The distal end 50B of the plunger rod 50 (not shown in FIG. 6—see FIG. 6A) is coupled to the plunger catcher 57. Rotation of the shaft 14 in a clockwise direction imparts a force applied by the distal end 13B of the lever arm 13 to the proximal end 51A of the intermediate link 51 which is coupled to transfer that force to the plunger rod 50 to move the plunger rod 50 outwardly from the case 12 in the direction of arrow 84A. The plunger rod 50 of FIG. 6 penetrates the distal wall 11A of the case 12 at an aperture 54. A seal 83 may be disposed intermediate the plunger rod and the distal wall 11A of the case 12. Additionally, sealing elements 85 may be used to further isolate the interior space 55 of the case 12 from pressurized fluids within the lubricator 116 (not shown in FIG. 6).

Figure 6A:
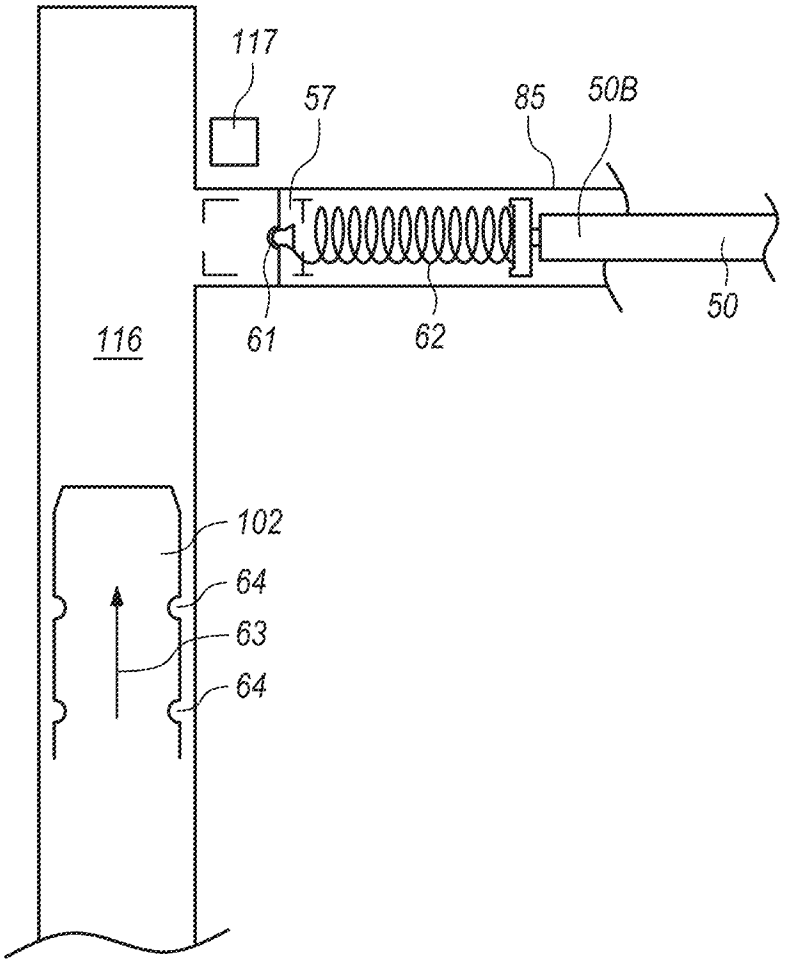
FIG. 6A is a view of a plunger rod with a plunger catcher connected to a lubricator of a wellhead, the plunger rod and plunger catcher being in the retracted configuration.

FIG. 6A is an enlarged view of a distal end 50B of the plunger rod 50 with a plunger catcher 61 positioned proximal to the lubricator 116 of a wellhead 100. FIG. 6A illustrates the plunger rod 50 and plunger catcher 61 being in the retracted configuration and the plunger 102 moving upwardly in the direction of arrow 63 into the lubricator 116. A spring 62 is disposed intermediate the distal end 50B of the plunger rod 50 and the plunger catcher 61. The plunger catcher 61 is shaped for secure engagement with one of a plurality of circumferential recesses 64 formed in the plunger 102. The actuator 10 remains inactive and the plunger rod 50 remains in the retracted position until the plunger sensor 117 detects the plunger 102 within the lubricator 116.

Figure 7:
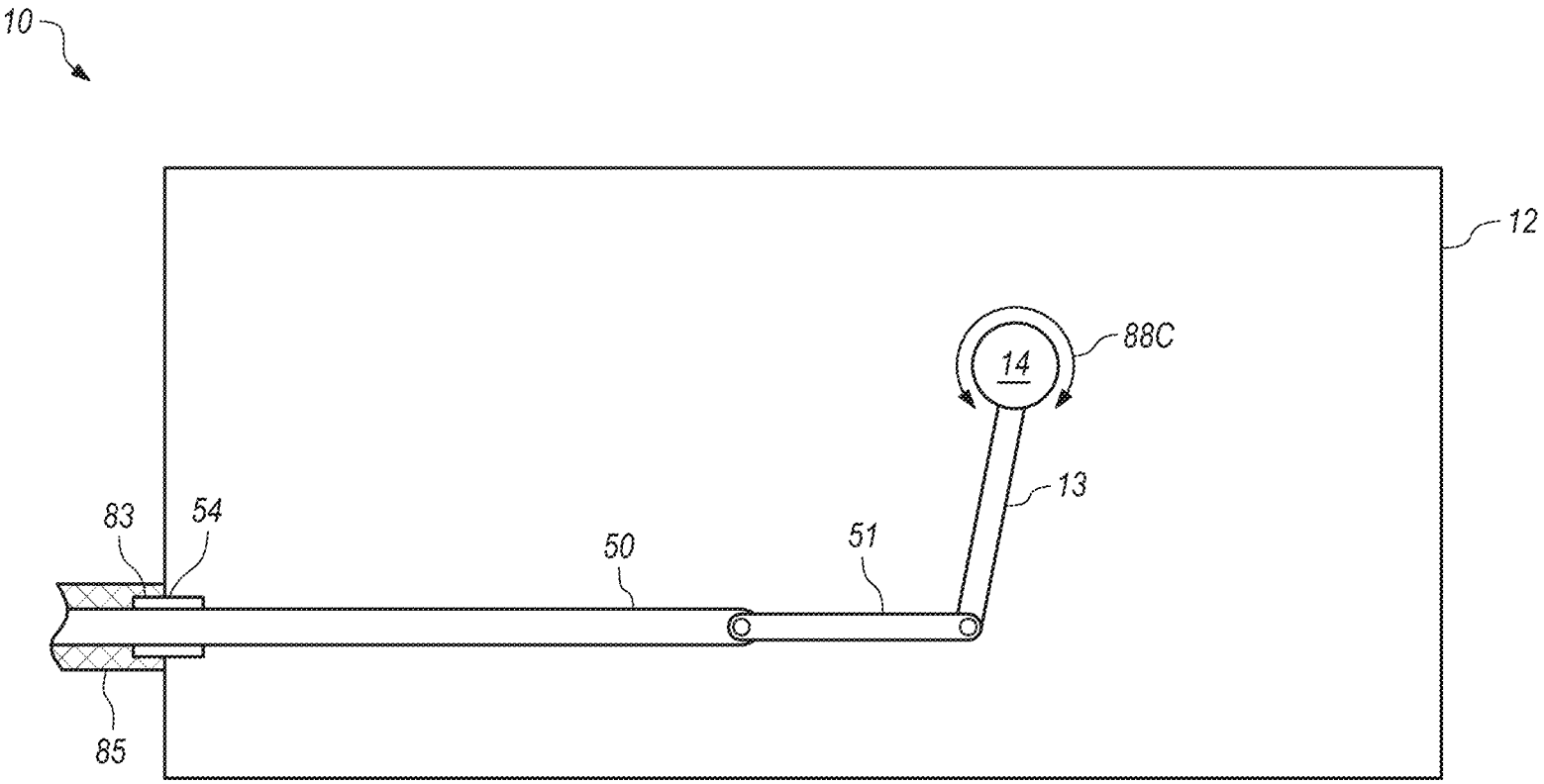
FIG. 7 is the sectional view of the automated plunger actuator of FIG. 6 after the actuator has been actuated to move the plunger rod to an extended configuration.

FIG. 7 is the sectional view of the automated plunger actuator 10 of FIG. 6 after the actuator 10 has been actuated to rotate the shaft 14 and the lever arm 13 in a clockwise direction to thereby displace the plunger rod 50 outwardly through the aperture 54 from the case 12 to an extended configuration.

Figure 7A:
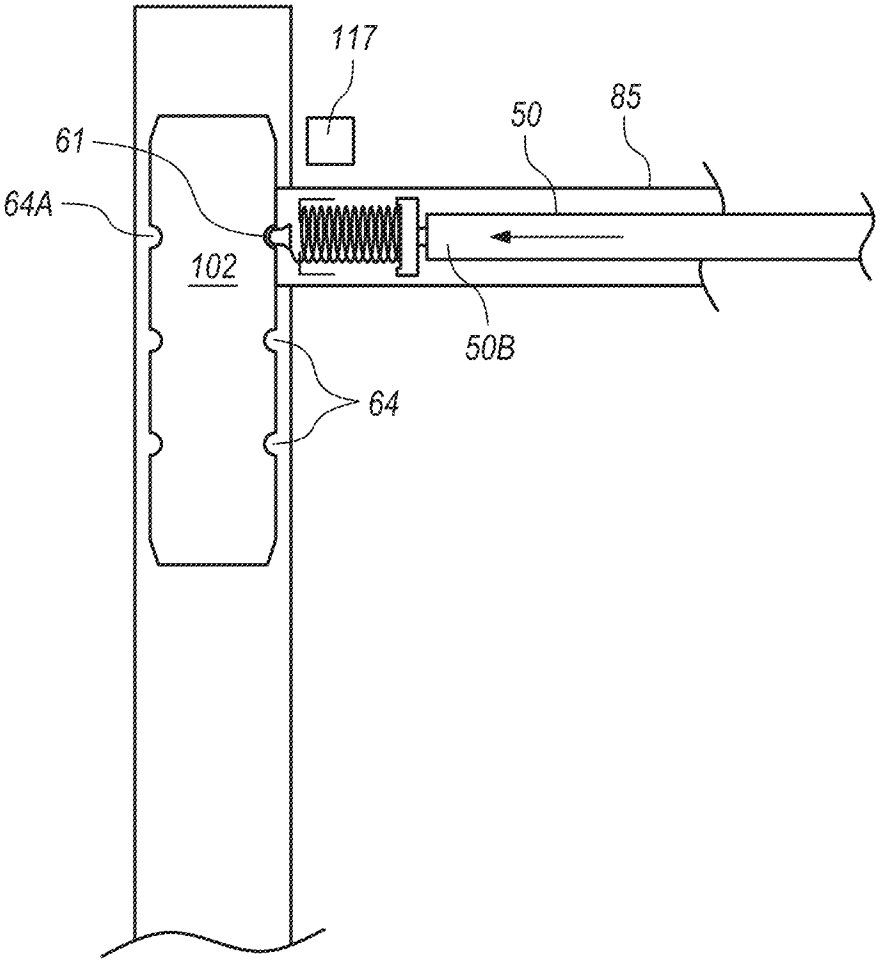
FIG. 7A is a view of the plunger rod with a plunger catcher of FIG. 7 in the extended configuration.

FIG. 7A is a view of the plunger rod 50 with the plunger catcher of FIG. 7 now in the engaged configuration with the plunger catcher 61 received within and bearing against the uppermost recess 64A of the plunger 102 to secure the plunger 102 within the lubricator 116. The force imparted by the distal end 50B of the plunger rod 50 is controlled by the torque generated by the shaft 14 (not shown in FIG. 7A) which is, in turn, controlled by the amount of current supplied by the battery 36 to the motor 34.

A wide variety of linkages can be used to coupled the rotatable shaft 14 to the plunger rod 50 to enable torque applied by the motor 34 to the shaft 14 to impart a predetermined amount of displacing force to the plunger rod 50. The linkage shown in FIGS. 6 and 7 is but one embodiment of the actuator 10 of the present invention. Similarly, a wide variety of plunger catchers 61 can be used to engage and secure the plunger 102 within the lubricator 116. The present invention is directed to an actuator 10 that produces the predetermined force as a result of the motor 34 being activated by a known current controlled by the processor/controller 38. Controlling the application of force to the plunger catcher 61 in this manner provides a more reliable apparatus for securing and releasing the plunger 102.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. An apparatus to operate a plunger catcher used with a plunger-assisted gas lift system, the apparatus, comprising:

a case having a mounting member for coupling the case in a fixed position relative to a lubricator on a wellhead, the case having an aperture to receive a plunger rod;

an electric motor connectable to a source of electrical current and having an output shaft controllably rotatable by the electric motor, at least a portion of the output shaft being within an interior of the case;

a current sensor to detect the current being provided to the electric motor and to generate a signal corresponding to the sensed current;

a processor/controller activatable by a signal from a plunger sensor disposed proximal to the lubricator of the wellhead, to receive the signal from the current sensor, to compare the signal from the current sensor to a set point, and to generate a control signal to the electric motor to generate a predetermined amount of torque to the output shaft; and a lever arm coupled to the output shaft of the electric motor at a first end of the lever arm, and coupled to the plunger rod at the second end of the lever arm;

wherein rotation of the output shaft by the electric motor rotates the lever arm to extend the plunger rod outwardly from the case; and wherein upon producing the predetermined amount of torque to the output shaft, the electric motor continues to produce that amount of torque until the control signal is changed.

2. The apparatus of claim 1, further comprising:

a motor enclosure that is connected to the case;

wherein the electric motor resides within the motor enclosure; and wherein the output shaft penetrates a wall of the motor enclosure and a wall of the case.

3. The apparatus of claim 2, further comprising a shaft seal disposed intermediate a wall of the case and the output shaft.

4. The apparatus of claim 1, further comprising:

a seal disposed intermediate the plunger rod and a wall of the case.

5. The apparatus of claim 1, wherein the motor enclosure is explosion proof.

6. The apparatus of claim 1, wherein the source of electrical current is a battery.

7. The apparatus of claim 6, wherein the battery is connected to at least one electrical current-generating solar panel.

8. A method of capturing and securing a plunger within a lubricator of a wellhead to enable the use of a plunger-assisted gas lift system, comprising the steps of:

providing a case connectable to the lubricator on a wellhead, the case having an aperture to receive a proximal end of a plunger rod, a motor coupled to a source of electrical current, a shaft rotatable by the motor and a linkage intermediate the shaft and the proximal end of the plunger rod to impart a force to displace the plunger rod in an outwardly direction from the case;

coupling a plunger catcher to a distal end of the plunger rod and in a position to be extended into the lubricator of the wellhead;

providing a plunger sensor proximal to the lubricator and adjacent to the plunger catcher to generate a signal upon detection of the plunger within the lubricator; and providing a processor/controller to control the amount of current provided by the source of electrical current to the motor upon receiving the signal from the plunger sensor;

wherein upon arrival of the plunger within the lubricator, the plunger sensor generates a signal to the processor/controller, which activates the motor by delivering a predetermined electrical current from the source of electrical current to the motor to drive the plunger rod outwardly from the case and engages the plunger catcher against the plunger, thereby securing the plunger within the lubricator.

9. The method of claim 8, further comprising:

providing one of a pressure sensor and a timer to generate a signal to the processor/controller upon detection of one of a predetermined pressure threshold and an elapsed time period;

wherein upon detection of the one of the predetermined pressure threshold and the elapsed time period, the processor/controller activates the motor to retract the plunger rod inwardly into the case to move the plunger catcher away from the plunger to release the plunger.

10. The method of claim 8, further comprising:

providing a solar panel to generate electrical current;

connecting the solar panel to a battery; and connecting the battery to the motor to provide electrical current to operate the motor to move the plunger rod.

11. The method of claim 8, further comprising:

providing a motor enclose adjacent to the case to enclose the motor and the processor/controller.

12. The method of claim 8, further comprising:

providing sealing elements round the plunger rod to isolate the case from pressurized fluids within the lubricator.

13. The method of claim 8, further comprising:

determining the desired amount of force to be applied to the plunger rod to secure the plunger within the lubricator;

determining the desired amount of torque to be imparted by the motor to the shaft to impart the desired amount of force to the plunger rod;

determining the desired amount of electrical current to be provided to the motor to generate the desired amount of torque;

entering a set point corresponding to the desired amount of electrical current to be provided to the motor; and programming the processor/controller to deliver the desired amount of electrical current from the source of electrical current upon receiving the signal from the plunger sensor.

* * * * *